US007817122B2

(12) United States Patent
Jang et al.

(10) Patent No.: US 7,817,122 B2
(45) Date of Patent: Oct. 19, 2010

(54) DRIVING METHOD OF IN-PLANE-SWITCHING MODE LCD

(75) Inventors: Sang Min Jang, Anyang-si (KR); Su Seok Choi, Hanam-si (KR)

(73) Assignee: LG Display Co., Ltd., Seoul (KR)

( * ) Notice: Subject to any disclaimer, the term of this patent is extended or adjusted under 35 U.S.C. 154(b) by 846 days.

(21) Appl. No.: 10/878,022

(22) Filed: Jun. 29, 2004

(65) Prior Publication Data

US 2005/0140617 A1 Jun. 30, 2005

(30) Foreign Application Priority Data

Dec. 26, 2003 (KR) ..... 10-2003-0097382

(51) Int. Cl.
*G09G 3/36* (2006.01)

(52) U.S. Cl. ..... 345/87; 345/92

(58) Field of Classification Search ..... 345/87, 345/92, 94

See application file for complete search history.

(56) References Cited

U.S. PATENT DOCUMENTS

| | | | | |
|---|---|---|---|---|
| 5,220,315 | A * | 6/1993 | Clerc | 345/93 |
| 5,526,012 | A * | 6/1996 | Shibahara | 345/92 |
| 5,532,712 | A * | 7/1996 | Tsuda et al. | 345/87 |
| 6,104,368 | A * | 8/2000 | Bonnett et al. | 345/94 |
| 6,144,353 | A * | 11/2000 | McKnight | 345/94 |
| 6,160,535 | A * | 12/2000 | Park | 345/88 |
| 6,304,239 | B1 | 10/2001 | McKnight | |
| 6,320,566 | B1 * | 11/2001 | Go | 345/99 |
| 6,335,719 | B1 * | 1/2002 | An et al. | 345/98 |
| 6,417,907 | B2 * | 7/2002 | Choi et al. | 349/141 |
| 6,549,255 | B2 * | 4/2003 | Stebler et al. | 349/127 |
| 7,030,843 | B2 * | 4/2006 | Youn | 345/86 |
| 2002/0118154 | A1 * | 8/2002 | Kim | 345/87 |
| 2003/0006949 | A1 * | 1/2003 | Sekiya et al. | 345/87 |
| 2003/0052847 | A1 * | 3/2003 | Okishiro et al. | 345/87 |
| 2004/0041768 | A1 * | 3/2004 | Chen et al. | 345/90 |
| 2007/0063940 | A1 * | 3/2007 | Juenger | 345/87 |

FOREIGN PATENT DOCUMENTS

| | | |
|---|---|---|
| JP | 07-084263 | 3/1995 |
| JP | 2002-072250 | 3/2002 |
| JP | 2003-066920 | 3/2003 |

* cited by examiner

*Primary Examiner*—Amare Mengistu
*Assistant Examiner*—Yuk Chow
(74) *Attorney, Agent, or Firm*—McKenna Long & Aldridge LLP

(57) ABSTRACT

A method of driving an IPS mode LCD includes applying a common voltage to a common electrode of the LCD panel, the LCD panel including a liquid crystal (LC) cell and driving the LC cell to express light at a predetermined brightness level associated with a predetermined data signal voltage applied to a pixel electrode, the driving including applying a compensation voltage to the LC cell prior to applying the predetermined data signal voltage, wherein a voltage difference between a previously applied data signal voltage and the compensation voltage is greater than a voltage difference between a previously applied data signal voltage and the predetermined data signal voltage.

12 Claims, 6 Drawing Sheets

DRIVING METHOD OF IN-PLANE-SWITCHING MODE LCD

This application claims the benefit of Korean Patent Application No. 97382/2003, filed on Dec. 26, 2003, which is hereby incorporated by reference for all purposes as if fully set forth herein.

BACKGROUND OF THE INVENTION

1. Field of the Invention

The present invention relates to liquid crystal display (LCD) devices. More particularly, the present invention relates to a driving method of an In-Plane Switching (IPS) mode LCD panel having a ferroelectric alignment film.

2. Discussion of the Related Art

Generally, LCD panels include a layer of liquid crystal material interposed between two glass substrates. Depending upon their construction and operation, LCD panels can be classified as Twisted Nematic (TN) mode LCD panels or In-Plane Switching (IPS) mode LCD panels.

TN mode LCD panels operate according to a perpendicular movement of liquid crystal molecules with respect to a substrate and include a transparent pixel electrode formed on a surface of one substrate and a common electrode formed on an opposing surface of an opposing substrate. Accordingly, the transparent electrodes apply an electric field, perpendicularly oriented with respect to the substrates, to the layer of liquid crystal material. Upon application of the electric field, liquid crystal molecules within the liquid crystal layer are moved perpendicularly with respect to the panel. TN mode LCD panels such as those described above can display images at a sufficiently high brightness but have a narrow range of viewing angles.

IPS mode LCD panels operate according to a parallel movement of liquid crystal molecules with respect to a substrate and include pixel and common electrodes formed on the same surface of only one of the two substrates. Accordingly, the electrodes apply a transverse electric filed, horizontally oriented with respect to the panel, to the layer of liquid crystal material. Upon application of the transverse electric field, liquid crystal molecules within the liquid crystal layer are moved along a parallel plane with respect to the substrates. Related art IPS mode LCD panels can display images over a wide range of viewing angles but do not display images at a sufficiently high brightness levels because the pixel and common electrodes, formed on the same substrate, block light emitted from a light source and reduce an aperture ratio of pixels within the LCD panel.

FIG. 1 illustrates a sectional view of a related art IPS mode LCD panel.

Referring to FIG. 1, the related art IPS mode LCD panel generally includes an upper substrate 10 and a lower substrate 12. A first alignment film 14A is formed on a surface of the upper substrate 10. A pixel electrode 16A and a common electrode 16B are formed on the surface of the lower substrate 12 and a second alignment film 14B is sequentially formed on the surface of the lower substrate 12 and on the pixel and common electrodes 16A and 16B. The upper substrate 10 and the lower substrate 12 are attached to each other such that the first alignment film 14A opposes the second alignment film 14B and liquid crystal layer 18 is interposed between the first and second alignment films 14A and 14B to form a liquid crystal (LC) cell.

Liquid crystal molecules within the liquid crystal layer 18 move along a plane parallel to the lower substrate 12 in response to traversely applied electric fields formed between the various electrode patterns formed on the lower substrate 12. By so moving the liquid crystal molecules, light transmittance characteristics of the LCD panel can be selectively controlled.

As described above, because both the pixel electrode 16A and the common electrode 16B are formed only on one of the substrates, an aperture ratio of pixels within the IPS mode LCDs is small, reducing the quantity of light transmitted by the related art IPS mode LCD panel to below a sufficient brightness level.

As is generally known, the related art TN and IPS mode LCD panels must be driven with a drive unit. Drive units typically include a central processing unit (CPU) that processes an externally input image signal and outputs synchronizing signals; a timing controller that generates a variety of signals from the synchronizing signals that enable the LCD panel to display images; a gate drive unit that supplies signal voltages to gate lines formed within the LCD panel using signals output by the timing controller; a data drive unit that supplies data signal voltages to data lines formed within the LCD panel using signals output by the timing controller; and a power source that generates a plurality of power voltages required by the drive unit.

Within each type of LCD panel, the lower substrate supports a plurality of gate lines, a plurality of data lines crossing the gate lines, a plurality of thin film transistors (TFTs) connected at crossings of the gate and data lines, wherein each TFT is turned on or off depending on a signal voltage applied to the gate line, and a plurality of pixel electrodes connected to the TFTs. When the TFT is turned on, a channel of the TFT is opened, a signal voltage applied to a predetermined data line is transmitted to the pixel electrode, and an electric field is generated between the pixel and common electrodes and an image is displayed on the LCD panel.

Liquid crystal material within the LCD panel may be prevented from degenerating by causing the data drive unit to supply a DC common voltage (Vcom) and DC data signal voltages having (+) and (−) polarities to the LCD panel. The data signal voltages having (+) and (−) polarities are alternately applied to the pixel electrodes between frames while the common voltage (Vcom) has a value corresponding to an average voltage of the applied data signal voltages and is applied to the common electrode.

FIG. 2 illustrates waveforms of voltages applied during a related art method of driving LCD panels.

Referring to FIG. 2, TFTs are turned on or off in accordance with an applied gate voltage. Therefore, when a gate high voltage Vgh of 21V is applied to a gate of a TFT, the gate is opened and the TFT is turned on. Conversely, when a gate low voltage Vgl of −5V is applied to a gate of a TFT, the gate is closed and the TFT is turned off. The common voltage (Vcom) applied to the common electrode constitutes a uniform DC waveform. The polarity of data signal voltages V2 and V1 applied to the LC cell is periodically inverted with respect to the common voltage according to a driving frequency of the LCD panel.

As shown in FIG. 2, the rising time 200 indicates the amount of time required by the LC cell to become effectively charged from data signal voltage V1 to data signal voltage V2 and transmit light at brightness level L3. Similarly, the falling time 210 indicates the amount of time required by the LC cell to become effectively charged from data signal voltage V2 to with data signal voltage V1 and transmit light at brightness level L1. The slow response speeds make it difficult for related art LCD panels to effectively display moving pictures.

SUMMARY OF THE INVENTION

Accordingly, the present invention is directed to a method of driving an LCD panel having a ferroelectric alignment film that substantially obviates one or more problems due to limitations and disadvantages of the related art.

An advantage of the present invention provides a method of driving an LCD panel having a ferroelectric alignment film wherein a rising or falling time required for an LC cell to express light at a predetermined brightness level associated with an applied image signal of a predetermined voltage is reduced by over-driving or under-driving the LC cell for a predetermined amount of time with a compensation voltage.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a method for driving an LCD panel may, for example, include applying a common voltage to a common electrode of the LCD panel, the LCD panel including a liquid crystal (LC) cell; driving the LC cell to express light at a predetermined brightness level associated with a predetermined data signal voltage applied to a pixel electrode, the driving including applying a compensation voltage to the LC cell prior to applying the predetermined data signal voltage, wherein a voltage difference between a previously applied data signal voltage and the compensation voltage is greater than a voltage difference between a previously applied data signal voltage and the predetermined data signal voltage.

In another aspect of the present invention, a method for driving an LCD panel may, for example, include generating an electric field between electrodes formed on first and second substrates, wherein the electric field is oriented perpendicularly with respect to a major surface of the first and second substrates; and altering an alignment direction of a liquid crystal layer along a plane parallel to the major surface of the first and second surfaces in the presence of the electric field.

In still another aspect of the present invention, an LCD panel may, for example, include a first substrate; a first electrode pattern on the first substrate; a first alignment layer on the first electrode pattern; a second substrate; a second electrode pattern on the second substrate; a second alignment layer on the second electrode pattern; and a liquid crystal layer adjacent to the first and second alignment layers, wherein the first and second alignment layers include ferroelectric liquid crystal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 3:
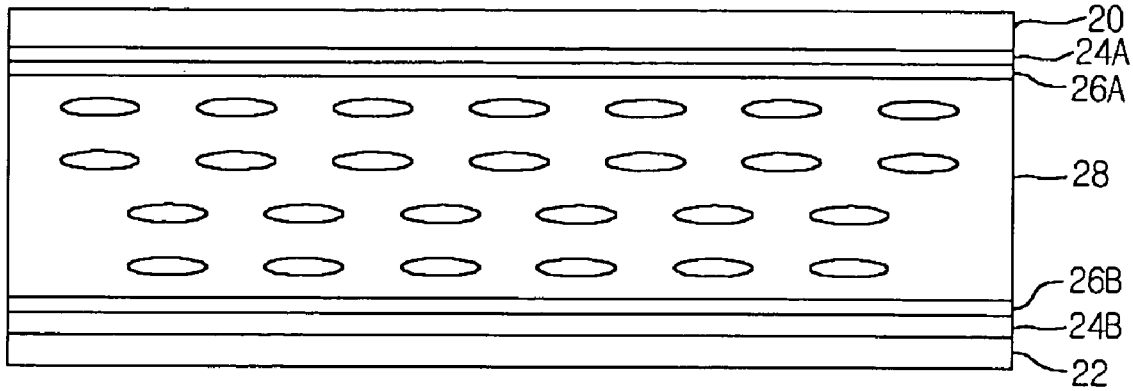
FIG. 3 illustrates a sectional view of an IPS mode LCD panel according to principles of the present invention.

FIG. 3 illustrates a sectional view of an IPS mode LCD panel according to principles of the present invention.

Referring to FIG. 3, the IPS mode LCD panel may, for example, include an upper substrate 20 and a lower substrate 22 opposing the upper substrate 20. A first electrode 24A may be formed on a lower surface of the upper substrate 20 and a first alignment film 26A may be formed on the first electrode 24A. A second electrode 24B may be formed on an upper surface of the lower substrate 22 and a second alignment film 26B may be formed on the second electrode 24B. A liquid crystal layer 28 may be formed between the first and second alignment films 26A and 26B.

In one aspect of the present invention, the first electrode 24A may be formed as a single electrode layer covering an entirety of the lower surface of the upper substrate 20. In another aspect of the present invention, the second electrode 24B may be formed as an electrode layer over the upper surface of the lower substrate 22.

Figure 1:
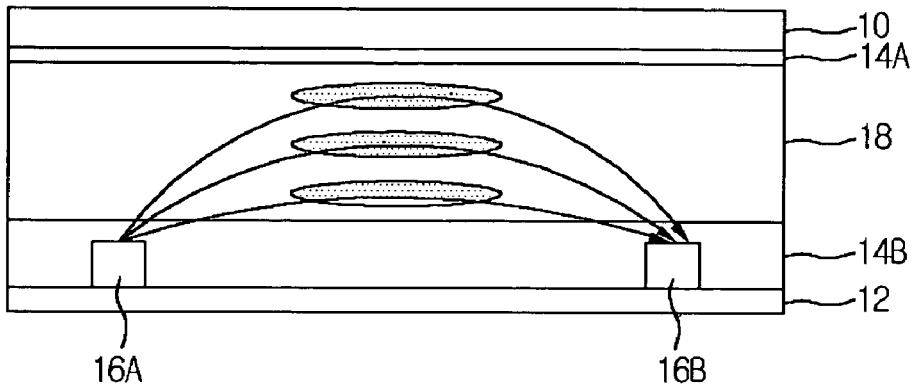
FIG. 1 illustrates a sectional view of a related art IPS mode LCD panel.
Figure 2:
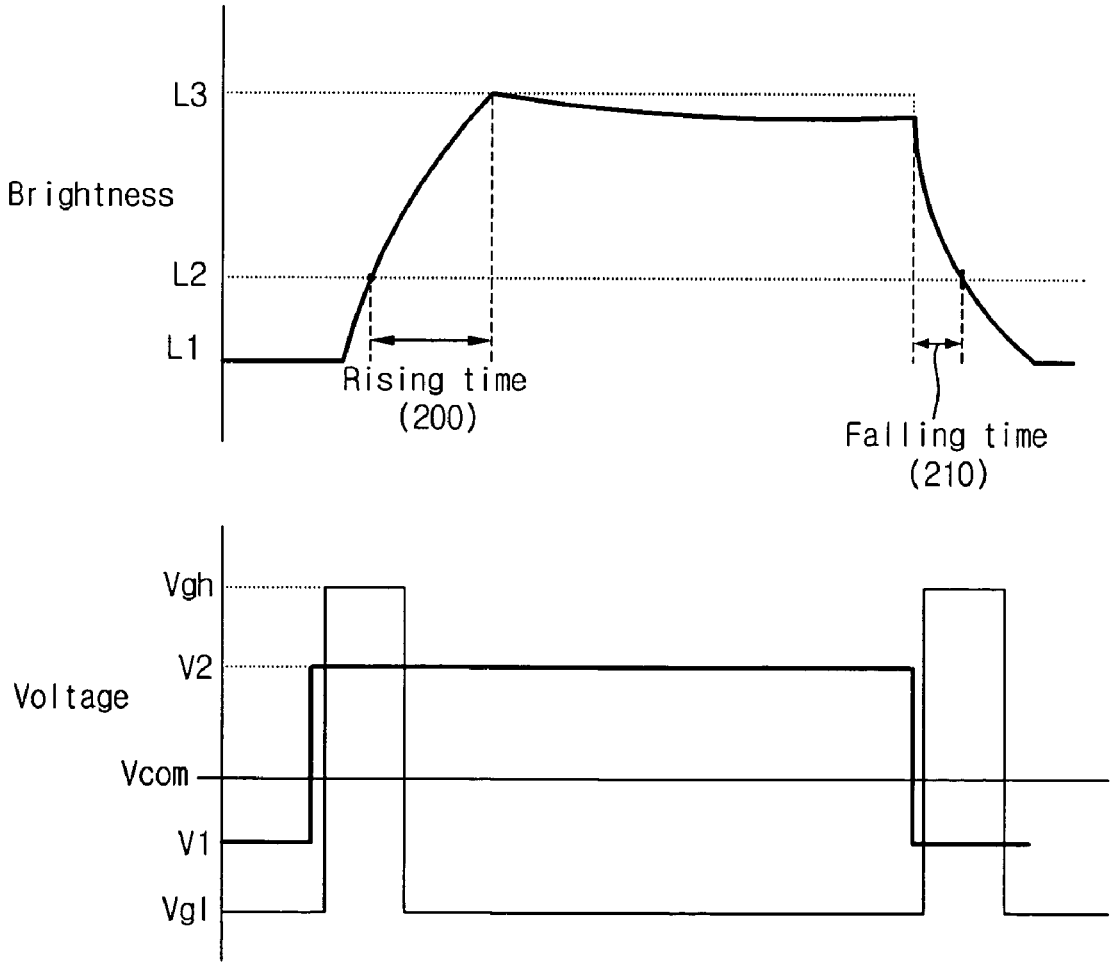
FIG. 2 illustrates waveforms of voltages applied during a related art method of driving LCD panels.

According to principles of the present invention, the first and second alignment films 26A and 26B may be formed of a material having molecules whose orientation can be altered in the presence of an electric field. Such an electric field may be generated by the first and second electrodes 24A and 24B and be oriented along a direction perpendicular to a plane of the upper and lower substrates 20 and 22. In one aspect of the present invention, the first and second alignment films 26A and 26B may be formed of a material such as ferroelectric liquid crystal polymer (FLCP). Accordingly, an orientation of molecules within the first and second alignment films 26A and 26B may be switched along a plane parallel to the surface of the upper and lower substrates 20 and 22, respectively. As a result, the LCD panel shown in FIG. 3 displays images over an increased range of viewing angles compared to the LCD panel shown in FIG. 1. Moreover, the LCD panels shown in FIG. 3 has a faster response speed due spontaneous polarization characteristics of the FLCP within the first and second alignment films 26A and 26B as compared to the LCD panel shown in FIG. 1.

Figure 4:
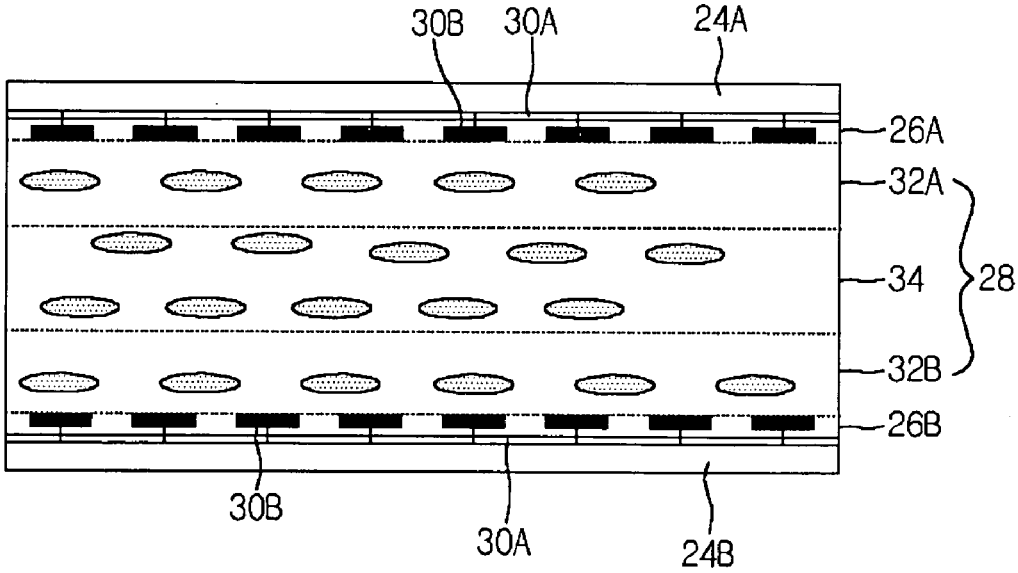
FIG. 4 illustrates an operation of the IPS mode LCD panel shown in FIG. 3.

Referring to FIG. 4, an electric field generated between first and second electrodes 24A and 24B may alter an orientation of FLCP molecules within respective ones of the first and second alignment films 26A and 26B such that main chains 30A and side chains 30B are formed at portions of the first and second alignment films 26A and 26B. In one aspect of the present invention, main chains 30A may be formed at surface portions of the first and second alignment films 26A and 26B that are adjacent to the upper and lower substrates 20 and 22. In another aspect of the present invention, side chains 30B may be formed at surface portions of the first and second alignment films 26A and 26B that are adjacent to the liquid crystal layer 28.

According to principles of the present invention, the side chains 30B may branch laterally from the main chain 30A. Further, the structure of portions of the side chains 30B that are adjacent to the liquid crystal layer 28 may become altered in the presence of an electric field applied between the first and second electrodes 24A and 24B. For example, portions of the side chains 30B may, in the presence of an electric field applied between the first and second electrodes 24A and 24B, move along a plane parallel to surfaces of the first and second alignment films 26A and 26B.

According to principles of the present invention, the liquid crystal layer 28 may be formed of a nematic liquid crystal material. In one aspect of the present invention, the liquid crystal layer may be formed of a positive-type nematic liquid crystal material. Alternatively, the liquid crystal layer 28 may be formed of a negative-type nematic liquid crystal material. When formed of the negative-type nematic liquid crystal, portions of liquid crystal molecules within the liquid crystal layer 28 may be conceptually divided into first and second command layers 32A and 32B, respectively, and a soldier layer 34. In one aspect of the present invention, an upper portion of the first command layer 32A may be adjacent to the first alignment film 24A. In another aspect of the present invention, a lower portion of the second command layer 32B may be adjacent to the second alignment film 24B. In yet another aspect of the present invention, an upper portion of the soldier layer 34 may be adjacent to a lower portion of the first command layer 32A and a lower portion of the soldier layer 34 may be adjacent to an upper portion of the second command layer 32B.

When an electric field is applied between the first and second electrodes 24A and 24B, liquid crystal molecules within the first command layer 32A move along a plane parallel to the surface of the first alignment film 26A according to a mechanical movement of side chains 30B of the first alignment film 26A. Similarly, when the electric field is applied between the first and second electrodes 24A and 24B, liquid crystal molecules within the second command layer 32B move along a plane parallel to the surface of the second alignment film 26B according to a mechanical movement of side chains 30B within the second alignment film 26B. Further, when the electric field is applied between the first and second electrodes 24A and 24B, liquid crystal molecules within upper and lower portions of the soldier layer 34 move along a plane parallel to the surfaces of the alignment films 26A and 26B according to a mechanical movement of liquid crystal molecules within the lower and upper portions of the first and second command layers 32A or 32B, respectively.

Therefore, upon application of the electric field between the first and second electrodes 24A and 24B, the first and second alignment films 26A and 26B change the structure of the side chains 30B to effect motion in the liquid crystal molecules of the first and second command layers 32A and 32B and soldier layer 34, wherein the effected motion is along a plane parallel to the surfaces of the upper and lower substrates 20 and 22.

Figure 5:
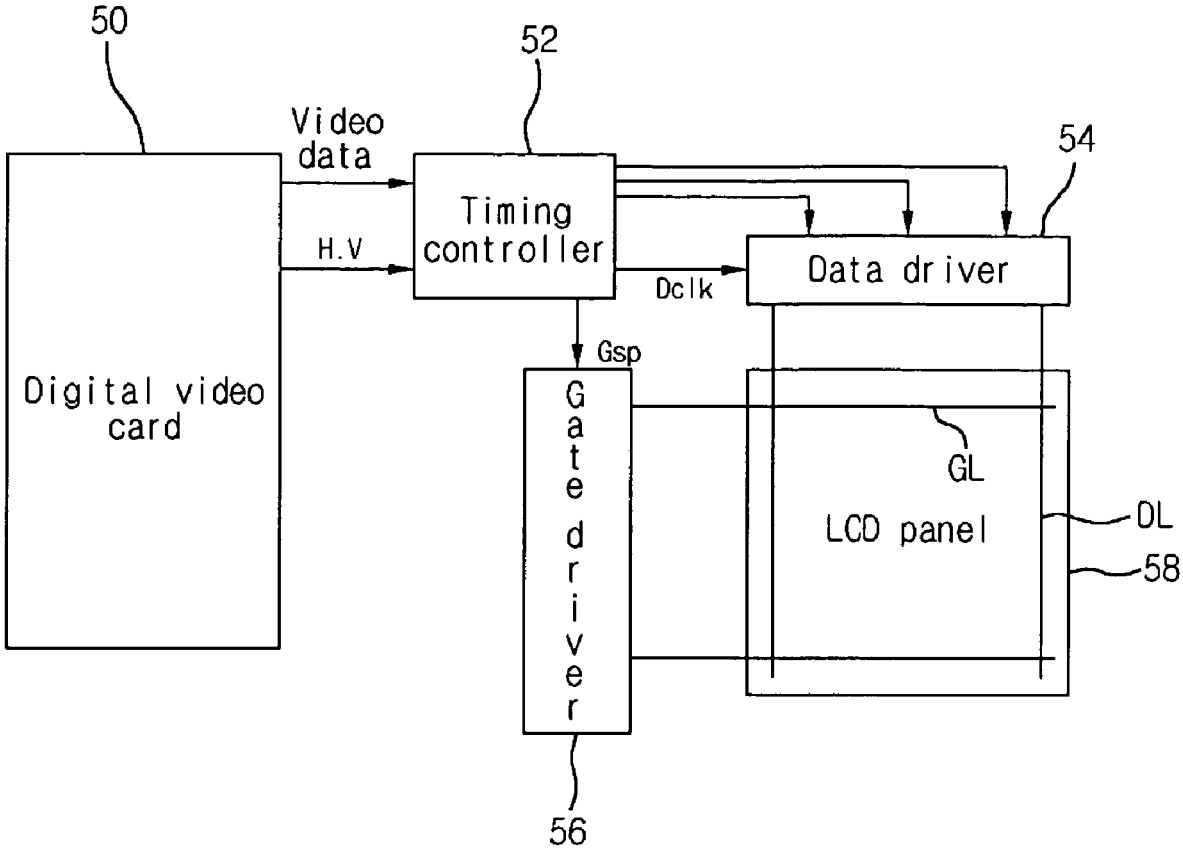
FIG. 5 illustrates a block diagram of an IPS mode LCD device according to principles of the present invention.

FIG. 5 illustrates a block diagram of an IPS mode LCD device according to principles of the present invention.

Referring to FIG. 5, an IPS mode LCD device may, for example, include a display unit and a driving unit.

According to principles of the present invention, the display unit may, for example, include an LCD panel 58 having a construction as exemplarily described above with respect to FIGS. 3 and 4. In one aspect of the present invention, the first and second electrodes 26A and 26B of such an LCD panel 58 may be provided as pixel and common electrodes.

In one aspect of the present invention, the lower substrate of the LCD panel 58 may support a plurality of gate lines GL and a plurality of data lines DL crossing the plurality of gate lines GL, a plurality of thin film transistors (TFTs) formed at the crossings of the gate lines GL and the data lines DL, and a plurality of pixel electrodes connected to the TFTs. In another aspect of the present invention, a gate electrode of each TFT may be connected to a gate line GL, a source electrode of each TFT may be connected to a DL, and a drain electrode of each TFT may be connected to a pixel electrode. Accordingly, each TFT may selectively supply data signal voltages, transmitted by the data lines DL, to an a pixel electrode. In still another aspect of the present invention, the upper substrate may support a common electrode. In yet another aspect of the present invention, however, the lower substrate may support the common electrode along with the pixel electrode.

According to principles of the present invention, the driving unit may, for example, include a digital video card 50 for converting analog video data into digital video data, a data driver 54 for supplying the digital video data to data lines DL of an LCD panel 58, a gate driver 56 for sequentially driving gate lines GL of the LCD panel 58, and a timing controller 52 for controlling the data driver 54 and the gate driver 56.

In one aspect of the present invention, the digital video card 50 may convert an analog image signal into a digital image signal suitable for being displayed by the LCD panel 58 and transmit synchronizing signals (e.g., horizontal/vertical synchronous signals (H/V)).

In one aspect of the present invention, the timing controller 52 may apply red (R), green (G) and blue (B) digital video data to the data driver 54. In another aspect of the present invention, the timing controller 52 may generate data and gate control signals such as dot clock (DclK), gate start pulse (Gsp), and the like, using the horizontal/vertical synchronous signals (H/V) and control a timing of the date driver 54 and the gate driver 56. In still another aspect of the present invention, the timing controller 52 may apply data control signals such as the dot clock (Dclk) signal to the data driver 54 and apply gate control signals such as the gate start pulse (Gsp) signal to the gate driver 56. In yet another aspect of the present invention, the timing controller 52 may apply the dot clock (Dclk) signal to the data driver 54 along with the red (R), green (G) and blue (B) digital video data.

In one aspect of the present invention, the gate driver 56 may, for example, include a shift register (not shown) for sequentially generating gate voltages in response to the gate start pulse (Gsp) output by the timing controller 52 and a level shifter (not shown) for shifting the gate voltage to a level suitable for the driving of the LCD panel 58. The generated gate voltages are transmitted from the gate driver 56 to predetermined TFTs via corresponding gate lines GL. Once transmitted, gates of each TFT are turned on and data signal voltages transmitted by the data lines DL are applied to corresponding pixel electrodes.

In one aspect of the present invention, the data driver 54 latch the red (R), green (G) and blue (B) digital video data in synchrony with the dot clock (Dclk) signal. Subsequently, the data driver 54 may correct the latched data according to a gamma voltage Vγ, convert the corrected data into an analog data voltage, and apply the analog data voltage to each of the data lines DL as data signal voltages.

The LCD panel 58 further includes an alignment film incorporating FLCP material. Accordingly, LCD panels formed in accordance with the principles of the present invention have beneficially fast response speeds due to spontaneous polarization characteristics exhibited by the FLCP material of the alignment film.

Further, the response speed of the inventive LCD panel may be reduced by varying the rising and falling time of LC cells (i.e., the amount of time required by the LC cell to alter its light transmittance characteristics from a darker to a brighter state, and vise versa).

LC cell response rates are influenced by, among other factors, a distance between the upper and lower substrates (i.e., the size of a cell gap), by inherent intermolecular elastic characteristics of the liquid crystal layer, and electric field strength. Therefore, a rising time, $\tau_{on}$, of an LC cell (i.e., the time required for a voltage level to rise to a first predetermined voltage within the LC cell), and a falling time, $\tau_{off}$, of a TFT (i.e., the time required for a voltage level to fall to a second predetermined voltage within the LC cell), are respectively expressed as follows:

$$\tau_{on} = \frac{\eta}{P_s E_1}, \text{ and } \tau_{off} = \frac{\gamma_1 d}{P_s E_2 + K_{22}\pi^2},$$

where $E_1$ represents a value of a first electric field generated between the pixel and common electrodes to charge the first predetermined voltage to the LC cell and $E_2$ represents a value of a second electric field generated between the pixel and common electrodes to charge the second predetermined voltage to the LC cell.

Figure 6:
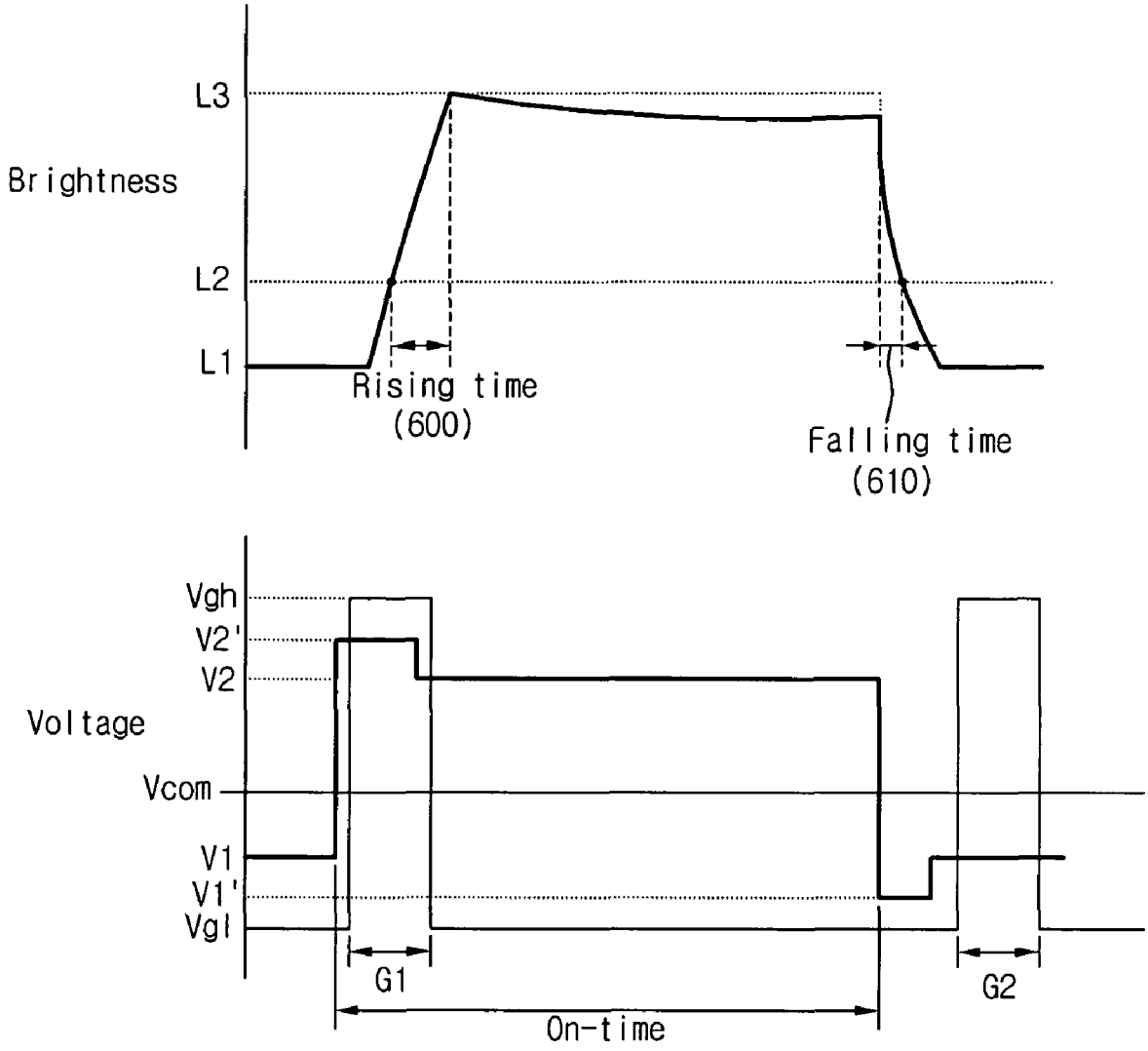
FIG. 6 illustrates waveforms of voltages applied to an IPS mode LCD panel in a driving method according to a first embodiment of the present invention.

FIG. 6 illustrates waveforms of voltages applied to an IPS mode LCD panel in a driving method according to a first embodiment of the present invention.

Referring to FIG. 6, TFTs within the LCD panel described above with respect to FIGS. 3-5 may be turned on or off in accordance with applied gate voltage. Therefore, when a gate high voltage Vgh of 21V is applied to a gate of a TFT, the gate is opened and the TFT is turned on. Conversely, when a gate low voltage Vgl of −5V is applied to a gate of a TFT, the gate is closed and the TFT is turned off. Further, the common voltage Vcom applied to the common electrode may constitute a uniform DC waveform. Moreover, data signal voltages V2 and V1 may be alternately applied to the pixel electrode of the LC cell in accordance with a driving frequency of the LCD panel. In one aspect of the present invention, the polarity of data signal voltage V2 may be opposite the polarity of data signal voltage V1.

According to principles of the present invention, a compensation voltage V2', having an absolute value greater than data signal voltage V2, may be applied to the data line during a first gate-ON period G1 of a TFT (i.e., when a transmitted gate voltage attains a value of Vgh and places a TFT in an ON-state). Applying the compensation voltage V2' will herein be referred to as 'over driving' the LC cell. Subsequent to over driving the LC cell, the data signal voltage V2 may be applied to the data line until the data signal voltage V1 is applied to the data line in accordance with the driving frequency of the LCD panel. Prior to applying the data signal V1, however, a compensation voltage V1', having an opposite polarity of data signal voltage V2 and having an absolute value greater than a data signal voltage V1, may be applied to the data line. Applying such a compensation voltage V1' will herein be referred to as 'under driving' the LC cell. Subsequent to the under driving, the data signal voltage V1 may be applied to the data line before a second gate-ON period G2.

By under driving the LC cell as described above, spontaneous polarization characteristics of FLCP within the alignment film are realized, reducing the falling time 610 within the LC cell compared to the falling time 610 of the related art LCD panel. By reducing the falling time 610 of the LC cell, the amount of time in which the LC cell exhibits the darker state (e.g., black) may be increased between consecutively driven frames, resulting in an LCD panel displaying images with an improved contrast ratio.

According to principles of the present invention, the actual values of compensation voltages V2' and V1', and durations in which they are applied, may correspond, at least in part, to the cell gap of the LCD panel and material properties of the liquid crystal used. In one aspect of the present invention, the compensation voltage V1' may be applied for a less amount of time than the compensation voltage V2' time to maximize the time during which the LC cell exhibits light to the predetermined brightness (i.e., the On-time). Similar to the manner in which the compensation voltage V1' reduces the falling time, the compensation voltage V2' reduces rising time 600.

Figure 7:
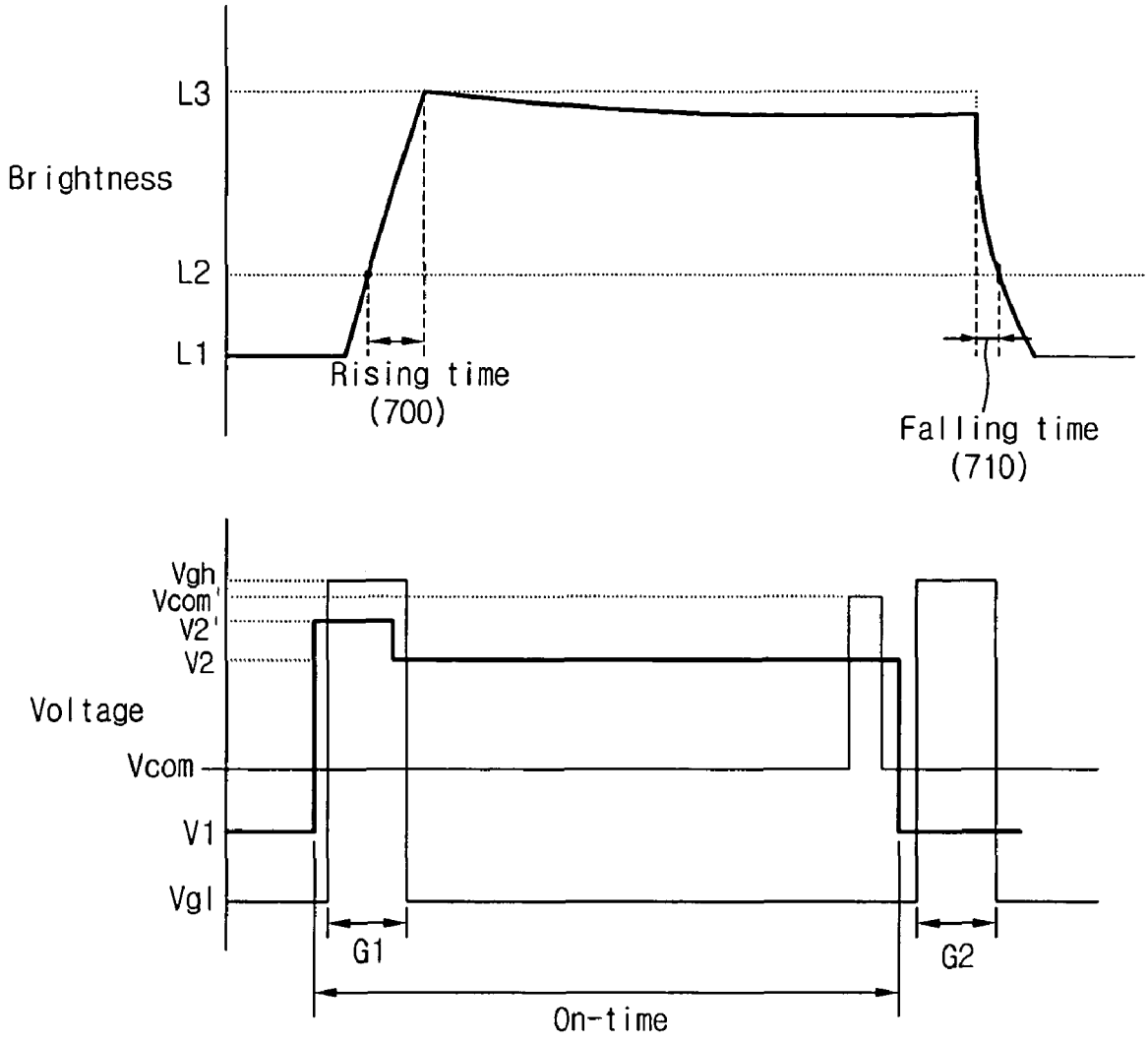
FIG. 7 illustrates waveforms of voltages applied to an IPS mode LCD panel in a driving method according to a second embodiment of the present invention.

FIG. 7 illustrates waveforms of voltages applied to an IPS mode LCD panel in a driving method according to a second embodiment of the present invention.

The waveforms exemplarily illustrated in FIG. 7 may be essentially identical to those illustrated in FIG. 6. However, as shown in FIG. 7, a compensation voltage Vcom', having the same polarity as the data signal voltage V2, instead of the compensation voltage V1', may be applied to the common electrode, instead of the data line, for a predetermined amount of time before a second gate-ON period G2. In one aspect of the present invention, the compensation voltage Vcom' may be applied to the common electrode before the data signal voltage V1 is applied to the data line in accordance with the driving frequency of the LCD panel.

While the second embodiment does not under drive the LC cell as described above with respect to the first embodiment, the second embodiment effects a reduction in falling time 710 of the LC cell as in the preceding embodiment. By reducing the falling time of the LC cell, the amount of time in which the LC cell exhibits the darker state (e.g., black) may be increased between consecutively driven frames, resulting in an LCD panel displaying images with an improved contrast ratio.

In one aspect of the present invention, the compensation voltage Vcom' may be applied for a less amount of time than the compensation voltage V2' to maximize the time during which the LC cell exhibits light to the predetermined brightness (i.e., the On-time). Similar to the manner in which the compensation voltage Vcom' reduces the falling time, the compensation voltage V2' reduces rising time 700.

Figure 8:
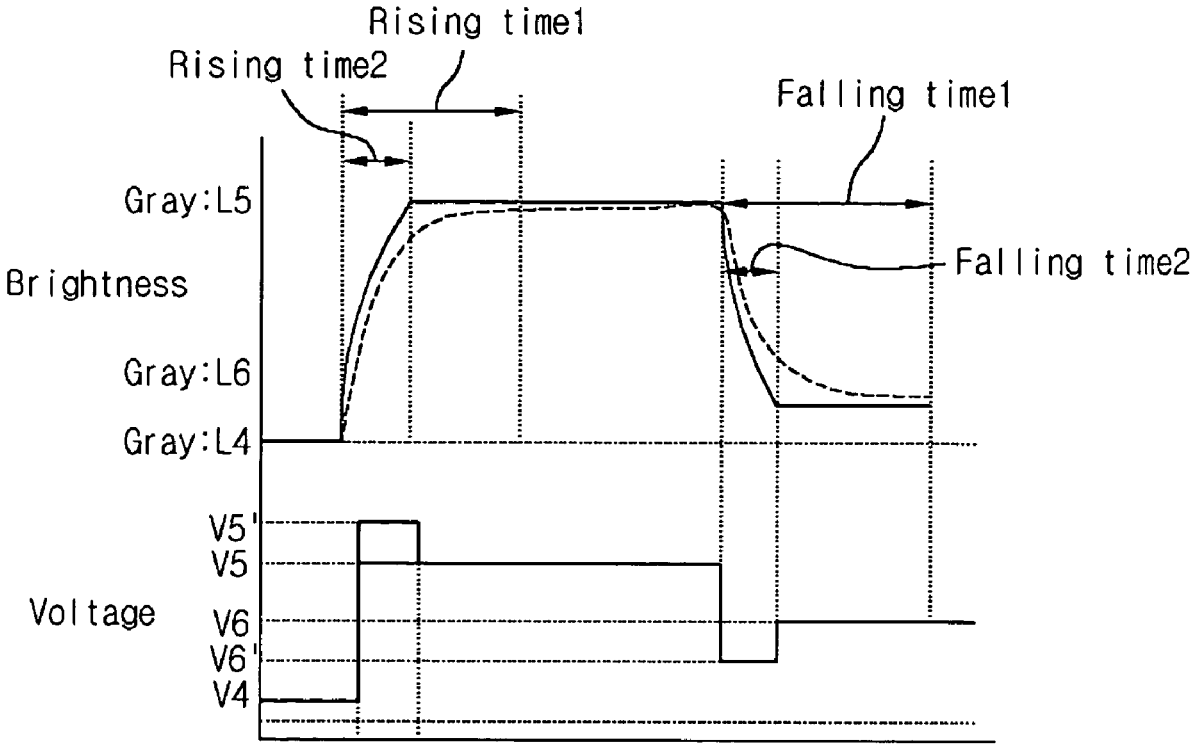
FIG. 8 illustrates waveforms of voltages applied to an IPS mode LCD panel in a driving method according to a third embodiment of the present invention.

FIG. 8 illustrates waveforms of voltages applied to an IPS mode LCD panel in a driving method according to a third embodiment of the present invention.

As shown in FIG. 8, the principles of the present invention, outlined above with respect to FIG. 6, may be applied to reduce the response time required to display any gray level.

For example, the response time required to increase the gray level of an image exhibited by an LC cell from L4 to L5 may be reduced by applying a compensation voltage V5' having a value greater than a data signal voltage V5, corresponding to the gray level L5. Subsequent to the over-driving, the data signal voltage V5 may be applied to the data line for a predetermined amount of time.

Further, the response speed required to reduce the gray level of an image exhibited by the LC cell from L5 to L6 may be reduced by applying a compensation voltage V6' having a value less than a data signal voltage V6, corresponding to gray level L6. Subsequent to the under-driving, the data signal voltage V6 may be applied to the data line for a predetermined amount of time.

The rising time 1 and falling time 1 shown in FIG. 8 indicate response times obtained by conventional driving methods while rising time 2 and falling time 2 indicate response times obtained by the driving method of the present invention. As is evident, response times obtained by the inventive driving method are reduced compared those obtained by the related art driving method.

As described above, the present invention provides a method of driving an IPS mode LCD panel may reduce rising and falling times of LC cells by over-or under-driving LC cells within the LCD panel with a compensation voltage for a predetermined amount of time. Accordingly, the amount of time in which the LC cell exhibits a dark state (e.g., black) may be increased between consecutively driven frames, resulting in an LCD panel displaying images with an improved contrast ratio.

In view of the above, it is appreciated that the driving method and other principles of the present invention are not restricted solely to IPS mode LCD panels but may be readily extended to any suitable type of LCD panel such as TN mode LCD panels, or the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display (LCD) panel, comprising:

applying a common voltage to a common electrode of the LCD panel, the LCD panel including a liquid crystal (LC) cell including a pixel electrode;

sequentially applying a gate signal voltage to a gate line of the LCD panel;

alternately applying a first data signal voltage and a second data signal voltage to a data line every a frame, wherein the first data signal voltage and the second data signal voltage have an opposite polarity each other;

applying a first compensation voltage to the pixel electrode for a first period of a present frame, wherein the first period is the high level state of the gate signal voltage;

applying a first data signal voltage for a second period of a present frame after the applying the first compensation voltage to the pixel electrode, wherein a voltage difference between the first compensation voltage and the common voltage is greater than a voltage difference between the first data signal voltage and the common voltage; and applying a second compensation voltage different from the first compensation voltage to the pixel electrode during a third period of the present frame after applying the first data signal voltage to the pixel electrode and before a next frame following the present frame, wherein the second data signal voltage is applied to the data line from the third period of the present frame, wherein the second compensation voltage has an opposite polarity of the first data signal voltage and the second compensation voltage is applied to a data line before applying the next gate signal voltage for the next frame, wherein the second compensation voltage has an absolute value greater than the second data signal voltage.

2. The method according to claim 1, wherein a magnitude of the first compensation voltage is greater than the first data signal voltage.

3. The method according to claim 1, wherein a magnitude of the second compensation voltage is less than that of the second data signal voltage.

4. The method according to claim 1, wherein a polarity of the first compensation voltage is the same as a polarity of the first data signal voltage.

5. The method according to claim 1, wherein a polarity of the first compensation voltage is opposite to a polarity of the second compensation voltage.

6. The method according to claim 1, wherein the first compensation voltage is applied during application of a first gate signal voltage to a gate line.

7. The method according to claim 1, wherein the first compensation voltage is applied for a different amount of time than the second compensation voltage.

8. The method according to claim 7, wherein the first compensation voltage is applied for a larger amount of time than the second compensation voltage.

9. The method according to claim 1, further comprising: generating an electric field between the pixel electrode and the common electrode formed on first and second substrates, wherein the electric field is oriented perpendicularly with respect to a major surface of the first and second substrates; and moving liquid crystal molecules of a liquid crystal layer along a plane parallel to the major surface of the first and second substrates in the presence of the electric field.

10. The method according to claim 9, wherein moving the liquid crystal molecules of the liquid crystal layer includes modifying the structure of alignment layers adjacent to the liquid crystal layer in the presence of the electric field.

11. The method according to claim 9, wherein the alignment layers include ferroelectric liquid crystal polymer.

12. The method according to claim 9, wherein the liquid crystal layer is a negative type liquid crystal layer.

* * * * *